US010378790B2

(12) United States Patent
Hou et al.

(10) Patent No.: US 10,378,790 B2
(45) Date of Patent: Aug. 13, 2019

(54) BOILING WATER HEATER

(71) Applicant: XIAMEN AQUASU ELECTRIC SHOWER CO., LTD, Xiamen (CN)

(72) Inventors: Quanduo Hou, Xiamen (CN); Yan Zeng, Xiamen (CN); Yihui Hong, Xiamen (CN); Yongliang Liu, Xiamen (CN); Bin Chen, Xiamen (CN); Weibin Li, Xiamen (CN)

(73) Assignee: XIAMEN AQUASU ELECTRIC SHOWER CO., LTD, Xiamen (CN)

( * ) Notice: Subject to any disclaimer, the term of this patent is extended or adjusted under 35 U.S.C. 154(b) by 414 days.

(21) Appl. No.: 15/262,019

(22) Filed: Sep. 12, 2016

(65) Prior Publication Data

US 2017/0248343 A1 Aug. 31, 2017

(30) Foreign Application Priority Data

Feb. 25, 2016 (CN) ..... 2016 1 0103819

(51) Int. Cl.
*F24H 1/20* (2006.01)
*F24H 1/18* (2006.01)
*F24H 9/20* (2006.01)

(52) U.S. Cl.
CPC ..... *F24H 1/182* (2013.01); *F24H 1/202* (2013.01); *F24H 9/2021* (2013.01)

(58) Field of Classification Search
None
See application file for complete search history.

(56) References Cited

U.S. PATENT DOCUMENTS 913,337 A * 2/1909 Wiffin ..... F25D 23/026 220/215
1,464,782 A * 8/1923 Stubbs ..... A47J 27/21033 219/546
2,044,573 A * 6/1936 Hornberger ..... H05B 1/0213 219/508
2,048,104 A * 7/1936 Clinefelter ..... B29C 35/04 165/104.19
2,435,981 A * 2/1948 Rawson ..... A47J 27/21108 220/567.3
2,457,065 A * 12/1948 Parmley ..... H05B 3/78 219/523
2,791,204 A * 5/1957 Andrus ..... F01K 1/02 122/33

(Continued)

*Primary Examiner* — Thor S Campbell
(74) *Attorney, Agent, or Firm* — Muncy, Geissler, Olds & Lowe, P.C.

(57) ABSTRACT

The invention discloses a boiling water heater, which includes a barrel shape internal tank body, a water inlet pipe, a water outlet pipe and a exhaust pipe, the upper end of the tank body, fixedly and hermetically connect to the first upper cover, the first upper cover is fixedly and hermetically connected to the second upper cover. One cavity is formed between the first and second upper covers, water inlet pipe passes through the second upper cover. An exhaust hole is set on the inner wall of water inlet pipe to connect to the cavity, a separation plate extended to the middle which is above the exhaust hole on water inlet pipe's internal wall. The invention has the characteristics of convenient installation and disassembly, convenient cleaning, and can ensure the quality of water flows out, and the production cost is low, and very safe for use.

9 Claims, 5 Drawing Sheets

(56) References Cited

U.S. PATENT DOCUMENTS

Figure 1:
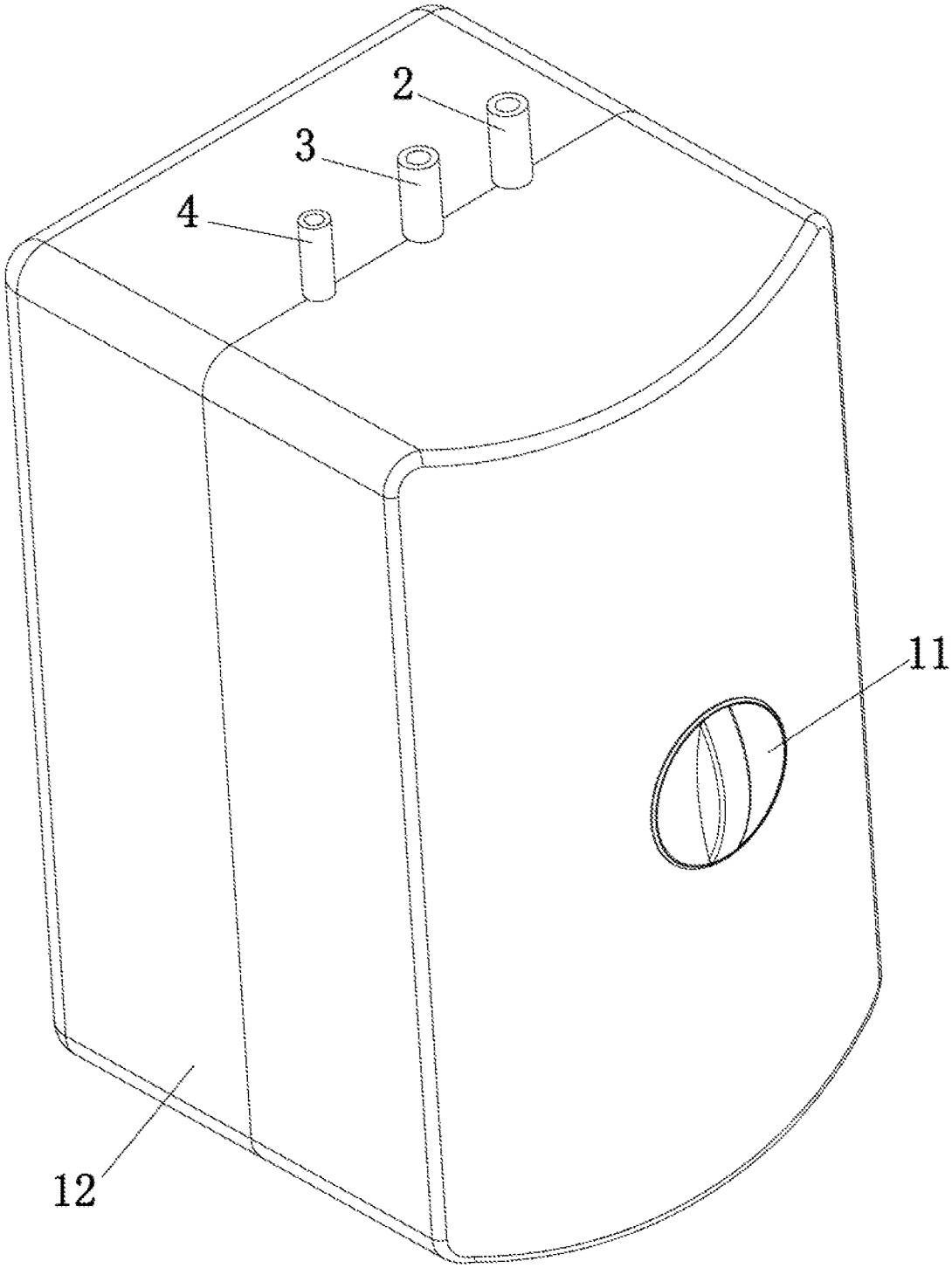

| | | | | | |
|---|---|---|---|---|---|
| 3,891,124 | A * | 6/1975 | Dreibelbis | F24D 17/00 | 222/108 |
| 4,513,887 | A * | 4/1985 | Wicke | F16B 7/0413 | 222/146.5 |
| 4,865,014 | A * | 9/1989 | Nelson | F24H 1/18 | 122/19.2 |
| 4,974,551 | A * | 12/1990 | Nelson | F24H 1/18 | 122/19.2 |
| 5,099,825 | A * | 3/1992 | Massey | F24H 9/124 | 122/13.01 |
| 5,838,879 | A * | 11/1998 | Harris | F24H 1/202 | 392/451 |
| 6,061,499 | A * | 5/2000 | Hlebovy | F24H 1/181 | 392/465 |
| 6,094,524 | A * | 7/2000 | Riley | F24H 1/188 | 392/441 |
| 6,266,485 | B1 * | 7/2001 | DeSantis | F24H 1/181 | 222/146.5 |
| 6,516,141 | B1 * | 2/2003 | DeSantis | A47J 31/56 | 222/146.5 |
| 6,577,817 | B2 * | 6/2003 | Harris | F24H 7/0433 | 392/479 |
| 6,659,048 | B1 * | 12/2003 | DeSantis | F24H 1/18 | 122/13.3 |
| 8,606,093 | B2 * | 12/2013 | Montanaro | B23K 26/103 | 392/441 |
| 9,797,625 | B2 * | 10/2017 | Chen | F24H 9/124 | |
| 10,077,919 | B2 * | 9/2018 | Adobati | A47J 31/54 | |
| 2007/0044736 | A1 * | 3/2007 | DeSantis | F24H 1/188 | 122/19.1 |

* cited by examiner

BOILING WATER HEATER

TECHNICAL FIELD

The invention relates to electric water heater, especially relates to a electric heating boiling water heater.

TECHNICAL BACKGROUND

In the electric water heater manufacturing technical field, most pressurized type electric water heaters can be directly connected to the main water supply with pressure, their structure usually use stainless steel and soldering to a sealed container as internal tank body, then install water inlet pipe, water outlet pipe, exhaust pipe and electric heating pipes, mounting safety valve on exhaust pipe, and stainless steel sealed container's outside has heat insulating protection layer and shell. If use this kind of electric water heater structure as heating and drinking water supply to people, there are some problems following. Firstly, the stainless steel soldering material can pollute water in the container, make water's drinking quality worse, secondly, the hermetical stainless steel container cannot be cleaned, after long time use, lime scale will be accumulated and affect water quality. Thirdly, if safety valve on the exhaust pipe does not work, it could cause use safety problem. Finally, sealed stainless steel container is difficult to manufacture, slow speed to produce and with high production cost.

SUMMARY OF THE INVENTION

The technical problem to be solved by the invention is to provide a type of boiling water heater, which is convenient to install, disassemble and clean, can make sure the quality of water. Also has the advantage of low production cost and high use safety.

In order to achieve above purpose, this invention's technical solution is: a boiling water heater, which includes a barrel shape internal tank body, water inlet pipe, water outlet pipe and exhaust pipe, the upper end of the tank body fixedly and hermetically connect to the first upper cover, the first upper cover is fixedly and hermetically connected to the second upper cover. One cavity is formed between the first and second upper covers, water inlet pipe passes through the second upper cover, the cavity and the first upper cover's one end that locate at lower part of the internal tank body, and one end of water outlet pipe is connected to the upper part of internal tank body. The electric heating pipes are installed in the tank body, the exhaust pipe through the second upper cover connects to the cavity, an exhaust hole is set on the inner wall of water inlet pipe to connect to the cavity, a separation plate extended to the middle which is above the exhaust hole on water inlet pipe's internal wall, and a transition through-bole provided in the middle of separation plate.

Furthermore, the water outlet pipe passes through the second upper cover, the cavity and one end of first upper cover are at the upper part of the internal tank body.

Furthermore, the water outlet pipe, the water inlet pipe and the first upper cover are jointed as one unit, the exhaust pipe and the second upper cover are jointed as one unit.

Furthermore, the water inlet pipe's bottom has a extension pipe.

Furthermore, the second upper cover has a first through-hole to let water inlet pipe's upper part go through, a sealing ring is fixed between water inlet pipe's upper external surface and first through-hole's inner wall, the second upper cover has a second through-hole to let water outlet pipe go through, the sealing ring is fixed between the water outlet pipe's external surface and the second through-hole's inner wall. In this way, the whole assembly is more convenient and the seal is more reliable.

Furthermore, the first upper cover and second upper cover are holding to each other, the sealing ring is fixed between the first upper cover and the second upper cover, a sealing membrane is fixed between the first upper cover's lower surface and the internal tank body's upper part. To help seal.

Preferred the internal tank body is made by stainless steel.

Furthermore, the internal tank body's outside has heat insulating layer, and with a temperature control knob. Temperature control knob controls heating pipes' working status according to the setting temperature. In order to control the water temperature in the tank body easily.

Furthermore, the cavity inside, a L-shaped pipe is fixedly connected to the water inlet pipe, lower part of L shape pipe's internal hole is connected to the exhaust hole, a gravity ball is installed on the upper part of L shape pipe's internal hole. Can decrease water flow into the cavity as much as possible, and to avoid water from water inlet pipe flowing out from exhaust pipe.

Furthermore, inner wall of the L-shape pipe's inner hole is inverted cone shape. Which is easier for the gravity ball's movement, and make exhaust performance more reliable.

As internal tank body is barrel shape, the upper end of the tank body fixedly and hermetically connect to the first upper cover, the first upper cover is fixedly and hermetically connected to the second upper cover under this invention, this kind of internal tank body structure can be made by stamping and extrusion. First upper cover and second upper cover can be made by injection or stamping and extrusion. The final whole tank body does not require soldering, and convenient to install, disassemble and clean, can make sure the quality of water. Also whole tank's production efficiency is high, cost is low.

On the other hand, one cavity is formed between the first and second upper covers, the exhaust pipe through the second upper cover connects to the cavity described before, an exhaust hole is set on the inner wall of water inlet pipe to connect to the cavity, a separation plate extended to the middle which is above the exhaust hole on water inlet pipe's internal wall, and a transition through-hole provided in the middle of separation plate. So that after water entering into water inlet pipe and goes through the transition through-hole, pressure is decreased, which prevent large amount of water discharge from exhaust hole, and help steam inside internal tank body discharge into the cavity through exhaust hole, then discharge from exhaust hole on the first upper cover. Therefore no need to have a safety valve on the exhaust pipe, which makes structure simple, reduce cost, further improving the safety performance.

BRIEF DESCRIPTION OF THE EMBODIMENT

Figure 2:
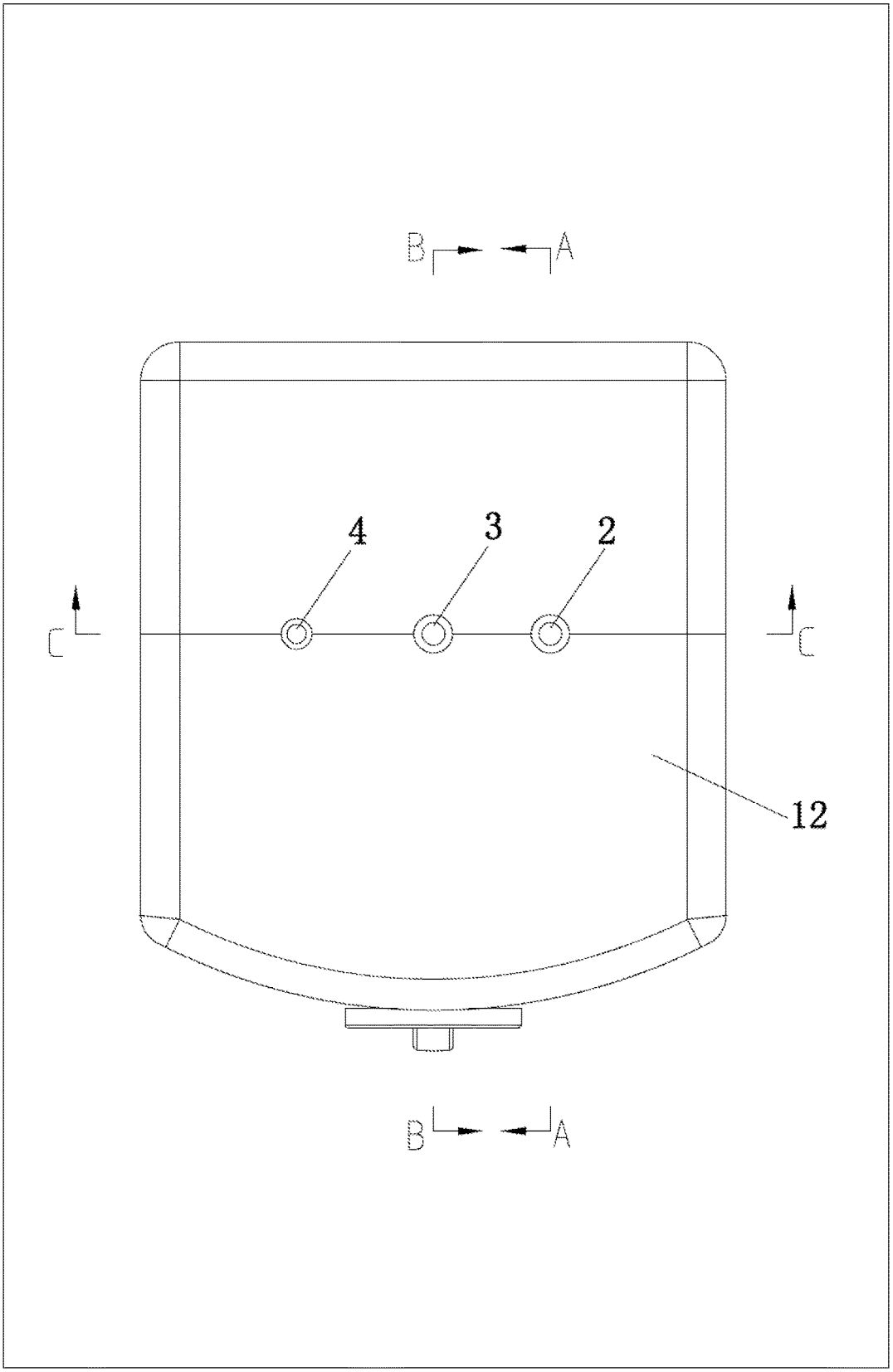
Figure 3:
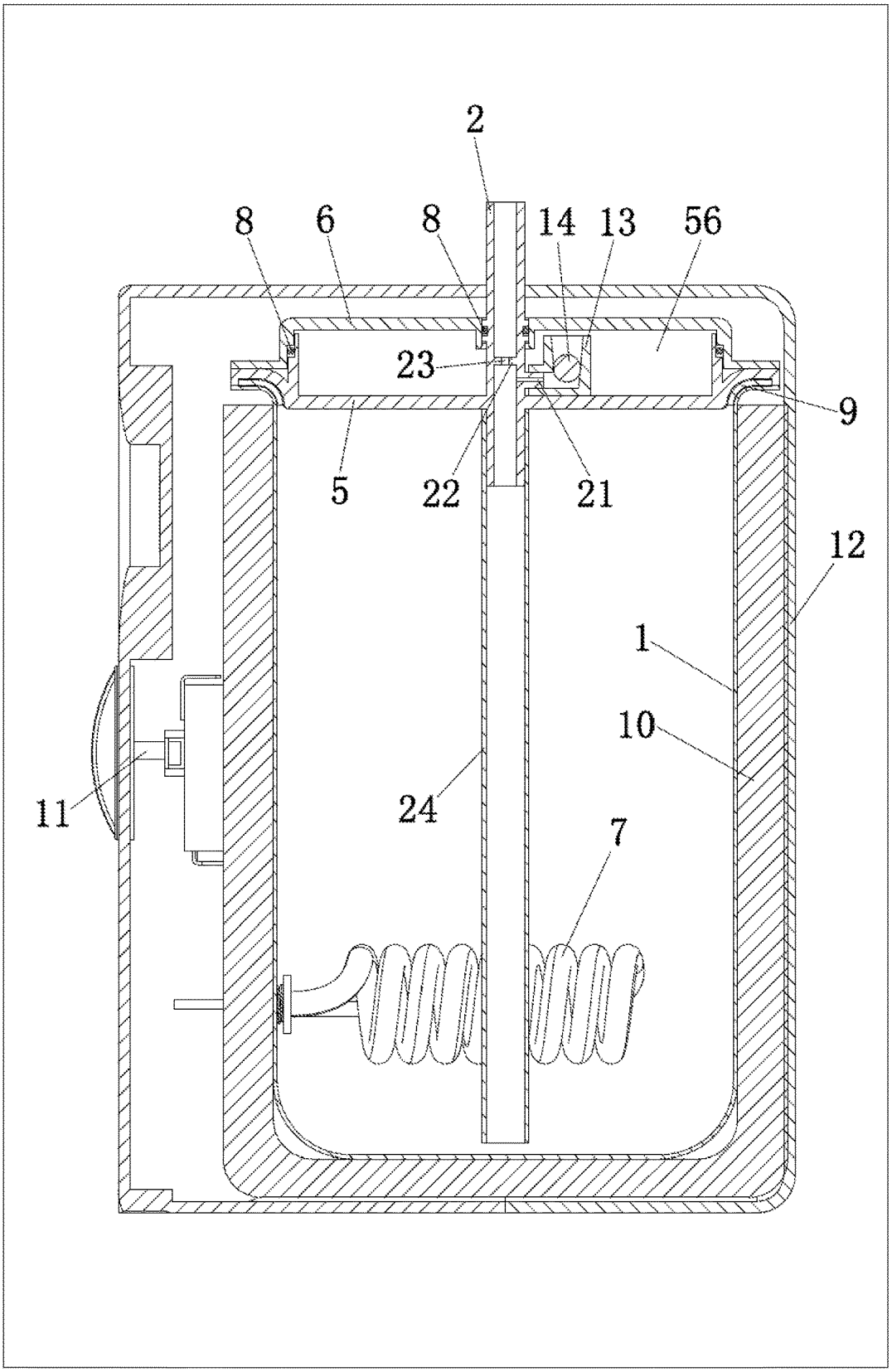
Figure 4:
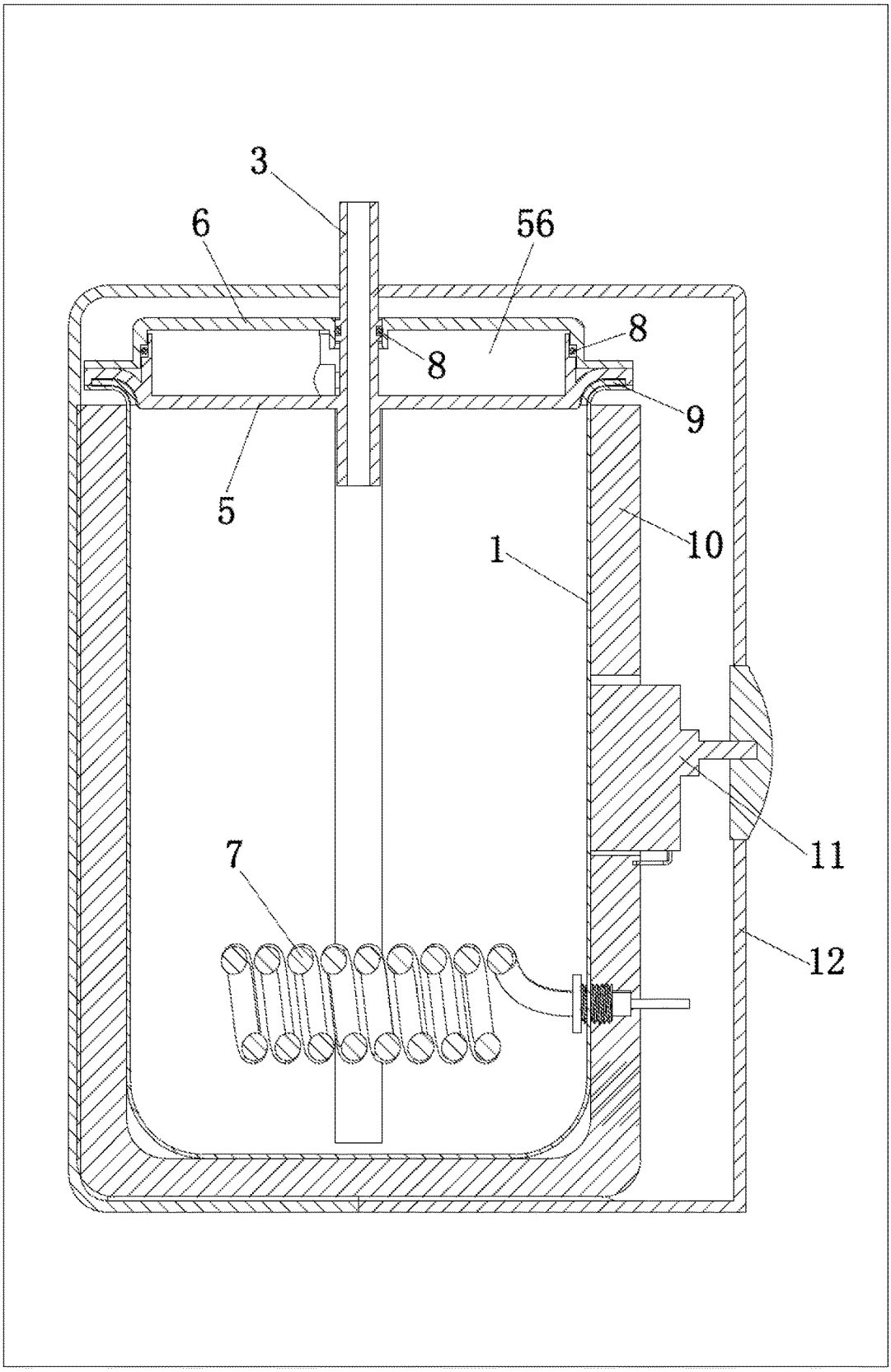
Figure 5:
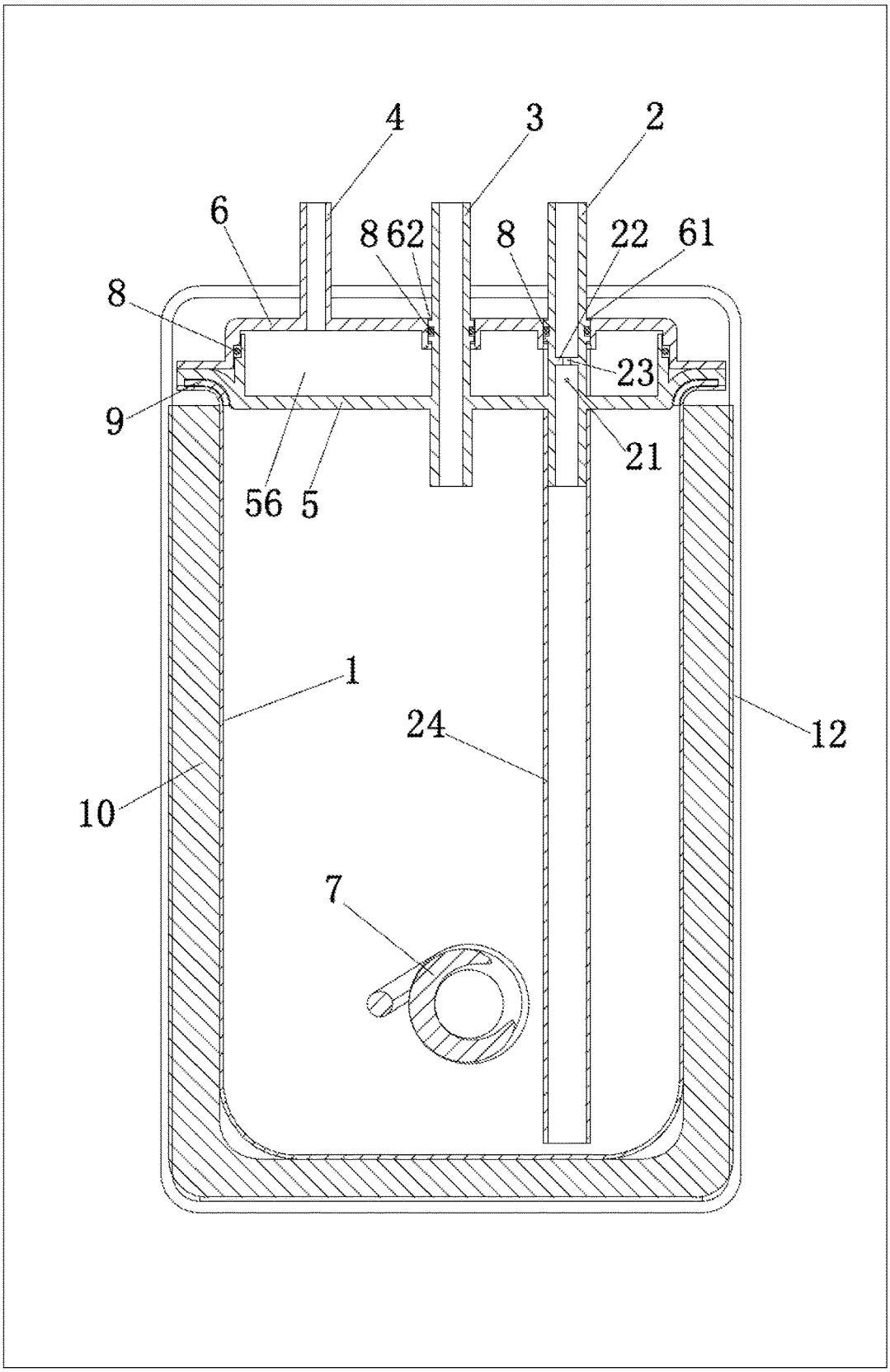

FIG. 1 is the three-dimensional diagram of the invention;
FIG. 2 is the top view diagram of the invention;
FIG. 3 is the A-A sectional view of FIG. 2:
FIG. 4 is the B-B sectional view of FIG. 2;
FIG. 5 is the C-C sectional view of FIG. 2.

DETAILED DESCRIPTION OF THE EMBODIMENT

Below in conjunction with the attached drawings and specific, embodiments of the present invention is described in further detail.

FIGS. 1-5 shows a type of boiling water heater, its feature is: barrel shape internal tank body 1, water inlet pipe 2, water outlet pipe 3, exhaust pipe 4. Internal tank body 1 is made by stainless steel stamping and extrusion, the upper end of tank body 1 fixedly and hermetically connect to first upper cover 5, the upper part of first upper cover 5 is fixedly and hermetically connected to second upper cover 6. One cavity 56 is formed between first upper cover 5 and second upper cover 6. First upper cover 5, second upper cover and internal tank body 1 can be locked tightly by screw bolts.

Water inlet pipe 2 passes through second upper cover 6, cavity 56 and first tipper cover 5's one end that locate at lower part of internal tank body 1, water outlet pipe 3 passes through second upper cover 6, cavity 56, first upper cover 5's one end that is located at internal tank body 1's inner upper part, so that water outlet pipe 5's one end can connect to internal tank body 1's upper part, electric heating pipes 7 are installed inside internal tank body 1, exhaust pipe 4 through second upper cover 6 connects to cavity 56, exhaust hole 21 is set on the inner wall of water inlet pipe 2 to connect to cavity 56, separation plate 22 is extended to the middle which is above exhaust hole 21 on water inlet pipe 2's internal wall, and transition through-hole 23 provided in the middle of separation plate 22.

First upper cover 5 and second upper cover 6 can use food grade plastic materials for injection molding, water inlet pipe 2, water outlet pipe 3 and first upper cover 5 are jointed as one unit, exhaust pipe 4 and second upper 6 are jointed as one unit, which can improve production efficiency and decrease the production cost.

The bottom of water inlet pipe 2 is sleeve connected with extension pipe 24, which can further reduce first upper cover 5's injection molding difficulty.

Second upper cover 6 has first through-hole 61 to let water inlet pipe 2's upper part go through, sealing ring 8 is fixed between water inlet pipe 2's upper external surface and first through-hole 61's inner wall, second upper cover 6 has second through-hole 62 to let water outlet pipe 3 go through, sealing ring 8 is fixed between water outlet pipe 3's external surface and second through-hole 62's inner wall.

First upper cover 5 and second upper cover 6 are holding to each other, sealing ring 8 is fixed between first upper cover 5 and second upper cover 6, sealing membrane 9 is fixed between first upper cover 5's lower surface and internal tank body 1's upper part.

Internal tank body 1's outside has heat insulating layer 10, and with temperature control knob 11. Temperature control knob 11 controls heating pipes' working status according to the setting temperature. So that water inside internal tank body 1 can reach setting temperature.

Heat insulating protection layer 10's outside has shell 12.

Inside cavity 56 describe, L-Shaped pipe 13 is fixedly connected to water inlet pipe 2, lower part of L shape pipe 13's internal hole is connected to exhaust hole 21, gravity ball 14 is installed on the upper part of L shape pipe 13's internal hole. L-shape pipe 13's inner hole is inverted cone shape.

When the invention is in use, water inlet pipe 2 is connected with main water supply water outlet pipe 3 is connected with the water outlet valve, water from main water supply system flow through transition through-hole 23 and enters into tank body 1 after decreasing the pressure, when water temperature in tank body 1 is lower than the setting temperature controlled by temperature control knob 11, heating pipe 7 starts to heat water, the steam produced during the water heating process enters the inner hole of L-shaped pipe 13 from exhaust hole 21, push up gravity ball 14 and enter into the cavity 56, then discharge from exhaust pipe 4; heating pipe 7 stops working, when water reaches the setting temperature, then turning on the water outlet valve, water outlet pipe 3 will have hot water with suitable temperature flows out.

Above is only a preferred example of this invention, technical people in this industry according to request to claim equivalent changes fall within the scope of protection of this case.

The invention claimed is:

1. A boiling water heater, includes a barrel shape internal tank body, a water inlet pipe, a water outlet pipe and a exhaust pipe, an upper end of the tank body fixedly and hermetically connect to a first upper cover, the first upper cover is fixedly and hermetically connected to a second upper cover; one cavity is formed between the first and second upper covers, the water inlet pipe passes through the second upper cover, the cavity and the first upper cover's one end that locate at a lower part of the internal tank body, and one end of the water outlet pipe is connected to an upper part of the internal tank body; electric heating pipes are installed in the tank body, the exhaust pipe through the second upper cover connects to the cavity, an exhaust hole is set on an inner wall of the water inlet pipe to connect to the cavity, a separation plate is extended to a middle which is above the exhaust hole on the water inlet pipe's internal wall, and a transition through-hole provided in the middle of the separation plate, wherein the cavity inside, a L-shaped pipe is fixedly connected to the water inlet pipe, a lower part of the L shape pipe's internal hole is connected to the exhaust hole, a gravity ball is installed on an upper part of the L shape pipe's internal hole.

2. The boiling water heater according to claim 1, wherein the water outlet pipe passes through the second upper cover, the cavity and one end of the first upper cover are at the upper part of the internal tank body.

3. The boiling water heater according to claim 2, wherein the water outlet pipe, the water inlet pipe and the first upper cover are jointed as one unit, the exhaust pipe and the second upper cover are jointed as one unit.

4. The boiling water heater according to claim 3, wherein the water inlet pipe's bottom has an extension pipe.

5. The boiling water heater according to claim 2, wherein a first through-hole is provided on the second upper cover to make an upper part of the water inlet pipe go through, a sealing ring is fixed between the water inlet pipe's upper external surface and the first through-hole's inner wall, a second through-hole is provided on the second upper cover to make the water outlet pipe go through, the sealing ring is fixed between the water outlet pipe's external surface and the second through-hole's inner wall.

6. The boiling water heater according to claim 1, wherein the first upper cover and the second upper cover are holding to each other, a sealing ring is fixed between the first upper cover and the second upper cover, a sealing membrane is fixed between the first upper cover's lower surface and the internal tank body's upper part.

7. The boiling water heater according to claim 1, wherein the internal tank body is made by stainless steel.

8. The boiling water heater according to claim 1, wherein the internal tank body's outside has a heat insulating layer, and with a temperature control knob; the temperature control knob controls the heating pipes' working status according to the setting temperature.

9. The boiling water heater according to claim 1, wherein an inner wall of the L-shape pipe's inner hole is inverted cone shape.

* * * * *